US007124991B1

(12) United States Patent
Williamson

(10) Patent No.: US 7,124,991 B1
(45) Date of Patent: Oct. 24, 2006

(54) LIGHTING UNIT

(76) Inventor: John P. Williamson, 3025 Roderick St., Morgan City, LA (US) 70380

( * ) Notice: Subject to any disclaimer, the term of this patent is extended or adjusted under 35 U.S.C. 154(b) by 190 days.

(21) Appl. No.: 10/733,164

(22) Filed: Dec. 11, 2003

Related U.S. Application Data

(60) Provisional application No. 60/432,422, filed on Dec. 11, 2002.

(51) Int. Cl.
*A47B 45/00* (2006.01)

(52) U.S. Cl. ..... 248/317; 248/323; 248/342; 248/343; 248/344; 362/85; 362/86; 362/133; 362/154

(58) Field of Classification Search ..... 312/223; 362/85, 86, 125, 126, 154, 133; 248/317, 248/323, 342, 343, 344; 52/143
See application file for complete search history.

(56) References Cited

U.S. PATENT DOCUMENTS 2,736,627 A * 2/1956 Horn ..... 312/213
3,863,945 A * 2/1975 Dunstan ..... 280/35
5,580,155 A * 12/1996 Hildebrand et al. ..... 362/133
6,478,444 B1 * 11/2002 Schaerer et al. ..... 362/133
6,669,213 B1 * 12/2003 Woerner ..... 280/47.35
6,676,275 B1 * 1/2004 Westhofen ..... 362/249

* cited by examiner

*Primary Examiner*—Sandra O'Shea
*Assistant Examiner*—Anabel Ton
(74) *Attorney, Agent, or Firm*—Garvey, Smith, Nehrbass & North, L.L.C.; Charles C. Garvey, Jr.

(57) ABSTRACT

A lighting and transport system includes a cabinet having an interior with an access panel that can be opened and closed for enabling a user to access the interior when the panel is open. The interior has a plurality of receptacles that include at least one vertically extending tall receptacle that is about as tall as the cabinet. A larger receptacle is provided that is shorter than the vertically extending tall receptacle and a plurality of smaller receptacles are provided that are each smaller in volume than the larger receptacle. At least one tripod is provided that is sized and shaped to be stored inside the cabinet within the tall receptacle. A plurality of electric lighting units are sized and shaped to be contained with the smaller receptacles.

15 Claims, 3 Drawing Sheets

LIGHTING UNIT

CROSS-REFERENCE TO RELATED APPLICATIONS

Priority of U.S. Provisional Patent Application Ser. No. 60/432,422, filed Dec. 11, 2002, incorporated herein by reference, is hereby claimed.

STATEMENT REGARDING FEDERALLY SPONSORED RESEARCH OR DEVELOPMENT

Not applicable

REFERENCE TO A "MICROFICHE APPENDIX"

Not applicable

BACKGROUND OF THE INVENTION

1. Field of the Invention

The present invention relates to the transportation of lighting equipment. More particularly the present invention relates to an improved lighting transport apparatus that features lighting components that disassemble for storage and transport in a cabinet having vertically and horizontally extending receptacles specially configured to efficiently and conveniently carry the lighting components.

2. General Background of the Invention

Lighting is often required in environments wherein explosions can occur because of natural gas or other volatile substances that might be in the area. In the offshore oil and gas exploration industry, explosion proof lighting is required on any offshore drilling or production platform.

In offshore oil and gas well drilling, platforms that are utilized have chronic space problems. However, the equipment must be taken to the platform that is supplemental equipment to that already located on the platform. Such is often the case with lighting that must be transported, typically by boat, to an offshore oil and gas well drilling platform or production platform. Once supplemental lighting arrives at the platform, the lack of space is compounded by the large lights and/or any containers that they are shipped in.

3. General Discussion of the Present Invention

The present invention solves the problems and shortcomings of the prior art by providing a new, improved lighting and transport system having particular utility in the oil and gas well drilling industry.

The present invention provides a lighting and transport system that includes a cabinet having an interior, an access panel that can be opened and closed for enabling a user to access the interior when the panel is opened, the interior having a plurality of receptacles including at least one vertically extending tall receptacle that is about as tall as the cabinet, a larger receptacle that is shorter than the vertically extending tall cabinet, and a plurality of small receptacles that are each smaller in volume than the larger receptacle.

One or more tripods are sized and shaped to be stored inside the cabinet and within the tall receptacle.

A plurality of electric lighting units are sized and shaped to be contained within the smaller receptacles.

A plurality of accessory components can be removably fitted into the tripods, the accessory components being non-lighting and non-electrical components.

Attachments on the cabinet are provided that enable a selected lifting device to connect to the cabinet at attachments for enabling a lifting device to elevate the cabinet such as from a supply boat to an elevated offshore marine platform.

BRIEF DESCRIPTION OF THE DRAWINGS

For a further understanding of the nature, objects, and advantages of the present invention, reference should be had to the following detailed description, read in conjunction with the following drawings, wherein like reference numerals denote like elements and wherein.

DETAILED DESCRIPTION OF THE PREFERRED EMBODIMENT

Figure 1:
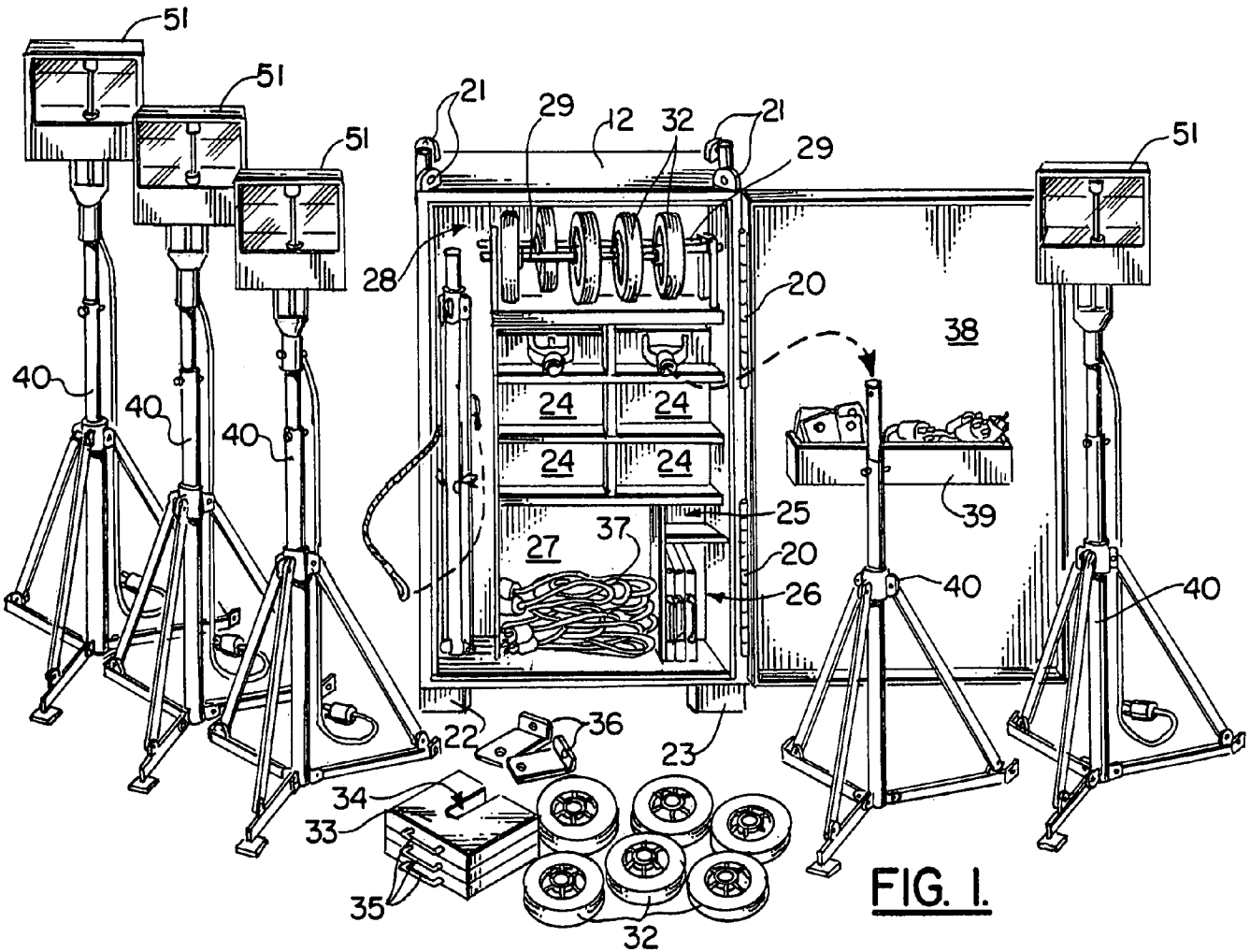
FIG. 1 is a perspective view of the preferred embodiment of the apparatus of the present invention.
Figure 5:
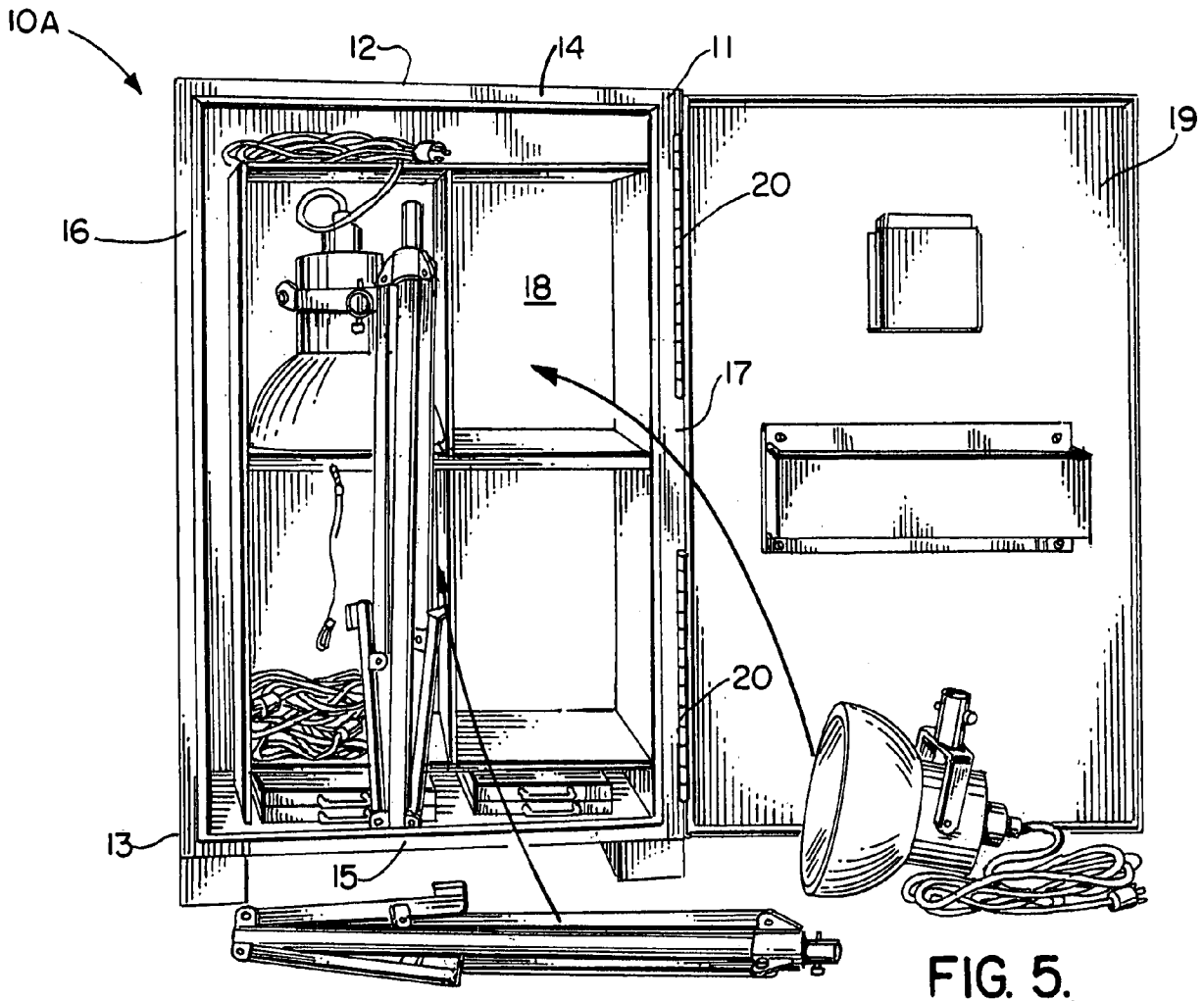
FIG. 5 is a front, elevation view of the preferred embodiment of the apparatus of the present invention.

FIGS. 1–5 show the preferred embodiment of the apparatus of the present invention, designated generally by the numeral 10 in FIGS. 1 and 5. Lighting and transport apparatus 10 includes cabinet 11 having upper end 11, lower end 13 and multiple walls 14–18 that encloses various receptacles 25–28 that house parts of lighting devices to be used at a selected location.

Walls 14–18 can include top wall 14, bottom wall 15, side walls 16, 17 and rear wall 18, access panel 19 can removably attach to cabinet 11 at hinge 20.

The apparatus 10 is easily transportable and easily liftable. A plurality of lifting eyes 21 are provided next to top wall 14, preferably being attached hereto using welded connections for example.

In addition to being lifted with a crane for example using lifting eyes 21, the apparatus 10 of the present invention provides preferably two sockets 22, 23 that are receptive of forklift tines. This enables the cabinet 11 to thus be lifted either with a crane or other cable supplied lifting device or with a forklift.

Figure 2:
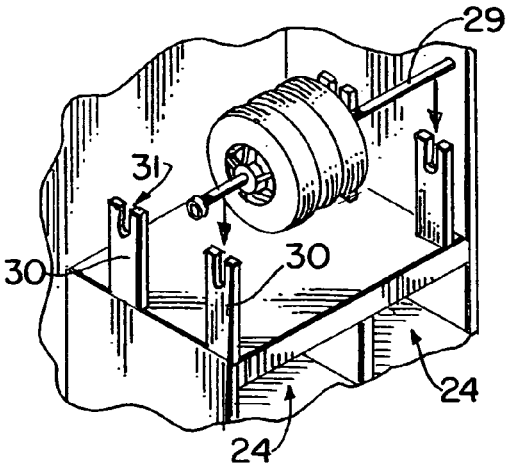
FIG. 2 is fragmentary perspective view of the preferred embodiment of the apparatus of the present invention.
Figure 4:
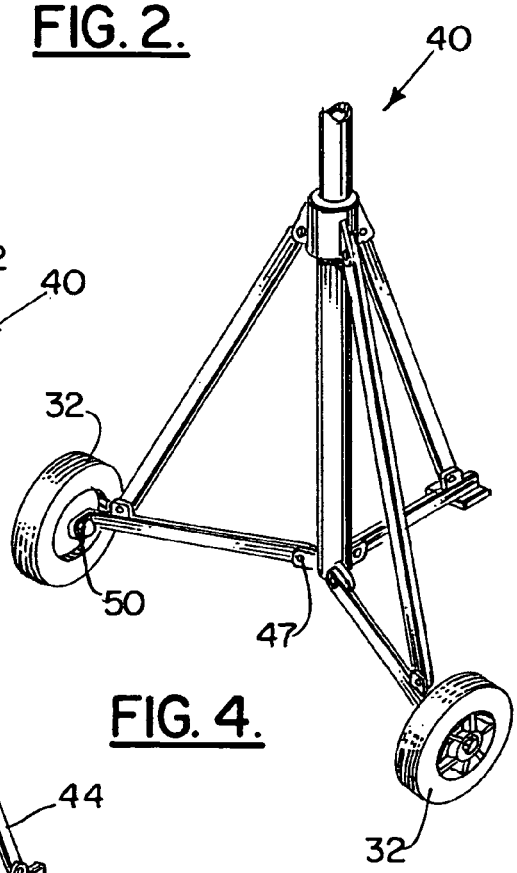
FIG. 4 is a fragmentary perspective view of the preferred embodiment of the apparatus of the present invention showing the tripod portion.

The cabinet 11 interior provides a number of receptacles including small receptacles 24–26, large receptacle 27, and tall receptacle 28. The tall receptacle 28 as shown in FIG. 1 can communicate with an upper part of the cabinet 11 that carries rod 29 for holding a plurality of wheels 32. The rod 29 in combination with supports 30 defines a wheel rack for holding a number of different wheels that can be interchangeably attached to the tripods 40 as shown in FIGS. 1–4. Slots 31 on each of the supports 30 can be used to cradle an end portion of each rod 29 as shown in FIG. 2. The wheels 32 and weights 33 define non-electrical, non-lighting components that can be added to the tripods 40 once they are removed from cabinet 11 for use on an offshore oil and gas well platform or like use. Each weight 33 has a slot 34 and a handle 35 for enabling an operator to grasp and move the weight 33. Tripod 40 provides three legs 44 and feet 36. The feet 36 can be held to a rig floor or other surface using the weights 33 when they are placed in a position shown in phantom lines in FIG. 3. Large receptacle 27 of cabinet 11 can hold power cords 37 for powering the explosion proof lamps or other lighting fixture or lighting unit 51 to be supported by tripods 40. Access panel 19 has inside surface 38 that can carry a panel receptacle 39 for holding various components to be used with tripods 40 and lighting units 51.

Each tripod 40 includes a pole 40, pole sections 42, 43, and legs 44. Collar 45 slides upon pull section 43. The pull sections 42 and 43 are preferably telescoping with respect to each other and adjustable so that the height of section 42 can be varied with respect to the lower section 41.

Figure 3:
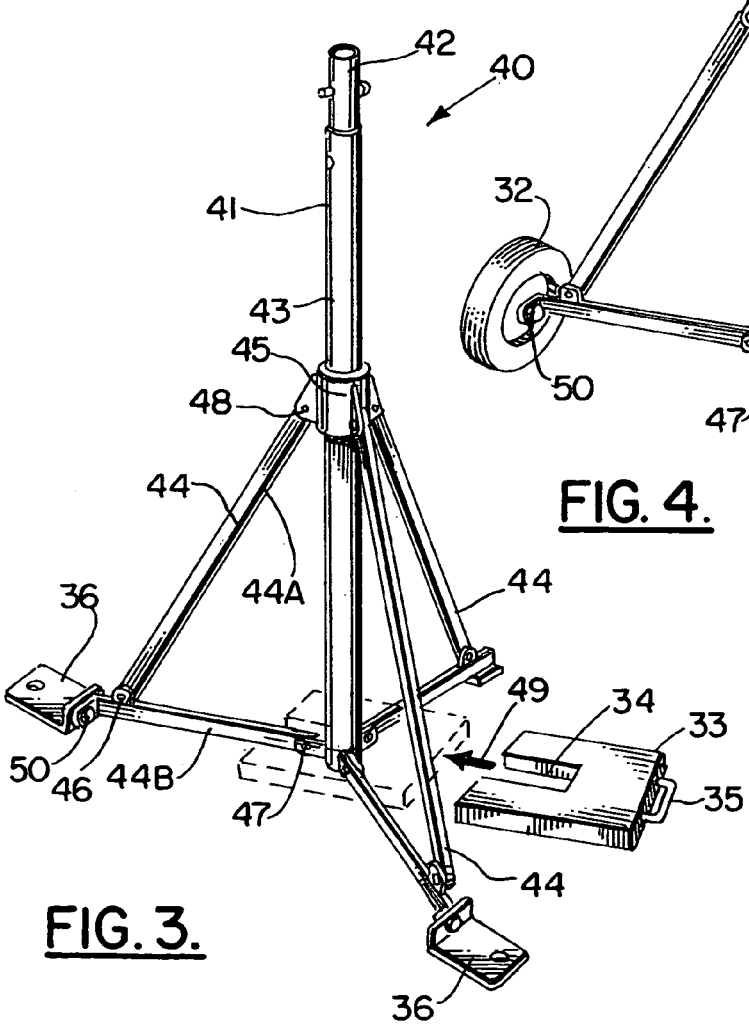
FIG. 3 is a partial perspective view of the preferred embodiment of the apparatus of the present invention.

Pinned connections 46, 47, 48 can be used for pivotally connecting a leg 44 sections 44A, 44B as shown in FIG. 3. Pinned connections 46, 47, 48 are provided for interfacing each of the legs 44 with collar 45. Arrow 49 in FIG. 3 illustrates the attachment of a weight 33 to tripod 40. Each of the feet 36 can be attached to legs 44 using flange 50 on leg 44 and a bolted connection for example.

PARTS LIST

The following is a list of suitable parts and materials for the various elements of the preferred embodiment of the present invention.

| PART NO. | DESCRIPTION |
|---|---|
| 10 | lighting and transport apparatus |
| 11 | cabinet |
| 12 | upper end |
| 13 | lower end |
| 14 | top wall |
| 15 | bottom wall |
| 16 | side wall |
| 17 | side wall |
| 18 | rear wall |
| 19 | access panel |
| 20 | hinge |
| 21 | lighting eye |
| 22 | socket |
| 23 | socket |
| 24 | small receptacle |
| 25 | small receptacle |
| 26 | small receptacle |
| 27 | large receptacle |
| 28 | tall receptacle |
| 29 | rod |
| 30 | wheel rack support |
| 31 | slot |
| 32 | wheel |
| 33 | weight |
| 34 | slot |
| 35 | handle |
| 36 | foot |
| 37 | power cord |
| 38 | inside surface |
| 39 | panel receptacle |
| 40 | tripod |
| 41 | pole |
| 42 | pole section |
| 43 | pole section |
| 44 | leg |
| 44A | leg section |
| 44B | leg section |
| 45 | collar |
| 46 | pinned connection |
| 47 | pinned connection |
| 48 | pinned connection |
| 49 | arrow |
| 50 | flange |
| 51 | lighting unit |

The foregoing embodiments are presented by way of example only; the scope of the present invention is to be limited only by the following claims.

The invention claimed is:

1. A lighting and transport system comprising:

a) a cabinet having an interior, an access panel that can be opened and closed for enabling a user to access the interior when the panel is opened, the interior having a plurality of receptacles including at least one vertically extending tall receptacle that is about as tall as the cabinet, a larger receptacle that is shorter than the vertically extending tall receptacle, and a plurality of smaller receptacles that are each smaller in volume than the larger receptacle;

b) at least one tripod that is sized and shaped to be stored inside the cabinet within the tall receptacle;

c) a plurality of electric lighting units that are sized and shaped to be contained within said smaller receptacles;

d) a plurality of accessory components that can be removably fitted to the tripod, said accessory components being non-electrical and non-lighting components;

e) attachments on the cabinet that enable a selected lifting device to connect to the cabinet at the attachments for enabling a lifting device to elevate the cabinet; and f) wherein the attachments on the cabinet include one or more forklift tine sockets.

2. The lighting and transport system of claim 1 wherein at least some of the electric lighting units are positioned in receptacles that are one above another.

3. A lighting and transport system comprising:

a) a cabinet having an interior, an access panel that can be opened and closed for enabling a user to access the interior when the panel is opened, the interior having a plurality of receptacles including at least one vertically extending tall receptacle that is about as tall as the cabinet, a larger receptacle that is shorter than the vertically extending tall receptacle, and a plurality of smaller receptacles that are each smaller in volume than the larger receptacle;

b) at least one tripod that is sized and shaped to be stored inside the cabinet within the tall receptacle;

c) a plurality of electric lighting units that are sized and shaped to be contained within said smaller receptacles;

d) a plurality of accessory components that can be removably fitted to the tripod, said accessory components being non-electrical and non-lighting components;

e) attachments on the cabinet that enable a selected lifting device to connect to the cabinet at the attachments for enabling a lifting device to elevate the cabinet; and f) wherein the lighting units have generally conically shaped shrouds.

4. A lighting and transport system comprising:

a) a cabinet having an interior, an access panel that can be opened and closed for enabling a user to access the interior when the panel is opened, the interior having a plurality of receptacles including at least one vertically extending tall receptacle that is about as tall as the cabinet, a larger receptacle that is shorter than the vertically extending tall receptacle, and a plurality of smaller receptacles that are each smaller in volume than the larger receptacle;

b) at least one tripod that is sized and shaped to be stored inside the cabinet within the tall receptacle;

c) a plurality of electric lighting units that are sized and shaped to be contained within said smaller receptacles;

d) a plurality of accessory components that can be removably fitted to the tripod, said accessory components being non-electrical and non-lighting components;

e) attachments on the cabinet that enable a selected lifting device to connect to the cabinet at the attachments for enabling a lifting device to elevate the cabinet; and f) wherein the lighting units are explosion proof lighting fixtures.

5. A lighting and transport system comprising:

a) a cabinet having an interior, an access panel that can be opened and closed for enabling a user to access the interior when the panel is opened, the interior having a plurality of receptacles including at least one vertically extending tall receptacle that is about as tall as the cabinet, a larger receptacle that is shorter than the vertically extending tall receptacle, and a plurality of smaller receptacles that are each smaller in volume than the larger receptacle;

b) at least one tripod that is sized and shaped to be stored inside the cabinet within the tall receptacle;

c) a plurality of electric lighting units that are sized and shaped to be contained within said smaller receptacles;

d) a plurality of accessory components that can be removably fitted to the tripod, said accessory components being non-electrical and non-lighting components;

e) attachments on the cabinet that enable a selected lifting device to connect to the cabinet at the attachments for enabling a lifting device to elevate the cabinet; and f) wherein the lighting fixtures that are rated Class 1, Division 1.

6. A lighting and transport system comprising:

a) a self supporting, transportable cabinet having an interior, an access panel that can be opened and closed for enabling a user to access the interior when the panel is opened, the interior being subdivided into a plurality of receptacles including at least one taller receptacle and a plurality of shorter receptacles that are each shorter than the taller receptacles;

b) a plurality of tripods that are sized and shaped to be stored inside the cabinet in the taller of the receptacles;

c) a plurality of lighting fixtures that are sized and shaped to be contained within a plurality of shorter receptacles, at least some of the fixtures being removably attachable to the tripod;

d) a plurality of accessory components that are connectable to the tripods, said accessory components being non-electrical and non-lighting components; and e) lifting attachments on the cabinet that enable a selected lifting device to connect to the cabinet at the attachments for enabling the lifting device to elevate the cabinet.

7. The lighting and transport system of claim 6 wherein the accessory components include a plurality of wheels.

8. The lighting and transport system of claim 6 wherein the accessory components include a plurality of weights.

9. The lighting and transport system of claim 6 wherein the accessory components include a plurality of tripod feet.

10. The lighting and transport system of claim 6 wherein the access panel is pivotally mounted to the cabinet.

11. The lighting and transport system of claim 6 wherein the attachments on the cabinet include lifting eyes.

12. The lighting and transport system of claim 6 wherein the attachments on the cabinet include one or more forklift tine sockets.

13. The lighting and transport system of claim 6 wherein the lighting units are positioned in receptacles that are one above another.

14. The lighting and transport system of claim 6 wherein at least some of the lighting units have generally conically shaped shrouds.

15. The lighting and transport system of claim 6 wherein the lighting units are explosion proof lighting fixtures.

* * * * *